US005626102A

United States Patent [19]

Nir

[11] Patent Number: 5,626,102

[45] Date of Patent: May 6, 1997

[54] HEAT RECOVERY SYSTEM FOR A BOILER AND A BOILER PROVIDED THEREWITH

[76] Inventor: Ari Nir, 2600 Netherlands Ave., Bronx, N.Y. 10463

[21] Appl. No.: 615,809

[22] Filed: Mar. 14, 1996

[51] Int. Cl.[6] ..... F22G 1/00; F22B 37/26

[52] U.S. Cl. ..... 122/7 R; 122/20 B; 122/34

[58] Field of Search ..... 122/7 R, 20 R, 122/20 B, 34, 36; 165/909, 47 B, 47 BW

[56] References Cited

FOREIGN PATENT DOCUMENTS

| | | | |
|---|---|---|---|
| 1148934 | 6/1983 | Canada | 165/47 BW |
| 1100853 | 10/1953 | Germany | 122/7 |

*Primary Examiner*—Henry A. Bennett
*Assistant Examiner*—Gregory A. Wilson
*Attorney, Agent, or Firm*—Ilya Zborovsky

[57] ABSTRACT

A heat recovery system for a boiler has a tank separator connectable to a boiler and receiving a liquid from the boiler as well as separating the liquid into a blow down liquid and a flush vapor, a heat exchanger having an upstream portion and a downstream portion and receiving a make up water to be heated, the tank separator being connected with the upstream portion of the heat exchanger so as to apply hot blow down water into the upstream portion of the heat exchanger therefore to heat the make up water in the upstream portion of the heat exchanger by heat given out by the blow down water, the heat exchanger further having a downstream portion connected with the upstream portion so that the make up water heated by the heat given out by the blow down water further flows into the downstream portion of the heat exchanger, the tank separator being connected with the downstream portion of the heat exchanger so as to supply the flush steam into the downstream portion of the heat exchanger and further heat the make up water in the downstream portion of the heat exchanger by heat given out by the flush steam in the downstream portion of the heat exchanger.

7 Claims, 3 Drawing Sheets

HEAT RECOVERY SYSTEM FOR A BOILER AND A BOILER PROVIDED THEREWITH

BACKGROUND OF THE INVENTION

The present invention relates to a heat recovery system for a boiler, and a boiler provided therewith.

It is known that boilers supply a hot liquid which is separated in a tank separator into a flush vapor and liquid. The liquid or the blow down water is then supplied to a heat exchanger into which a make up water is supplied as well. The make up water is heated in the heat exchanger by the heat given out by the blow down water. The cooled blow down water then flows to sewage, while the heated make up is supplied to the boiler. It is believed that it is possible to further improve the heat recovery from the boiler.

SUMMARY OF THE INVENTION

Accordingly, it is an object of the present invention to provide a heat recovery system for a boiler and a boiler provided therewith, in which an additional heat recovery can be obtained for heating the make up water and therefore the heat recovery becomes more efficient.

In keeping with these objects and with others which will become apparent hereinafter, one feature of the present invention resides, briefly stated, in a heat recovery system which includes a tank separator receiving a liquid from a boiler and separating it into blow down liquid and flush steam, a heat exchanger into which the blow down water is supplied and into which a make up water is supplied for heating by heat given out by the blow down water, wherein in accordance with the present invention the flush steam is supplied to an additional heat exchanger through which the make up water flows as well so that heat given out by the flush steam in the additional heat exchanger is transferred to the make up water and further heats the make up water.

When the heat recovery system is designed in accordance with the present invention, it is more efficient and provides additional heat recovery so that the overall efficiency of the system is improved.

The invention also deals with a boiler provided with the above mentioned heat recovery system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
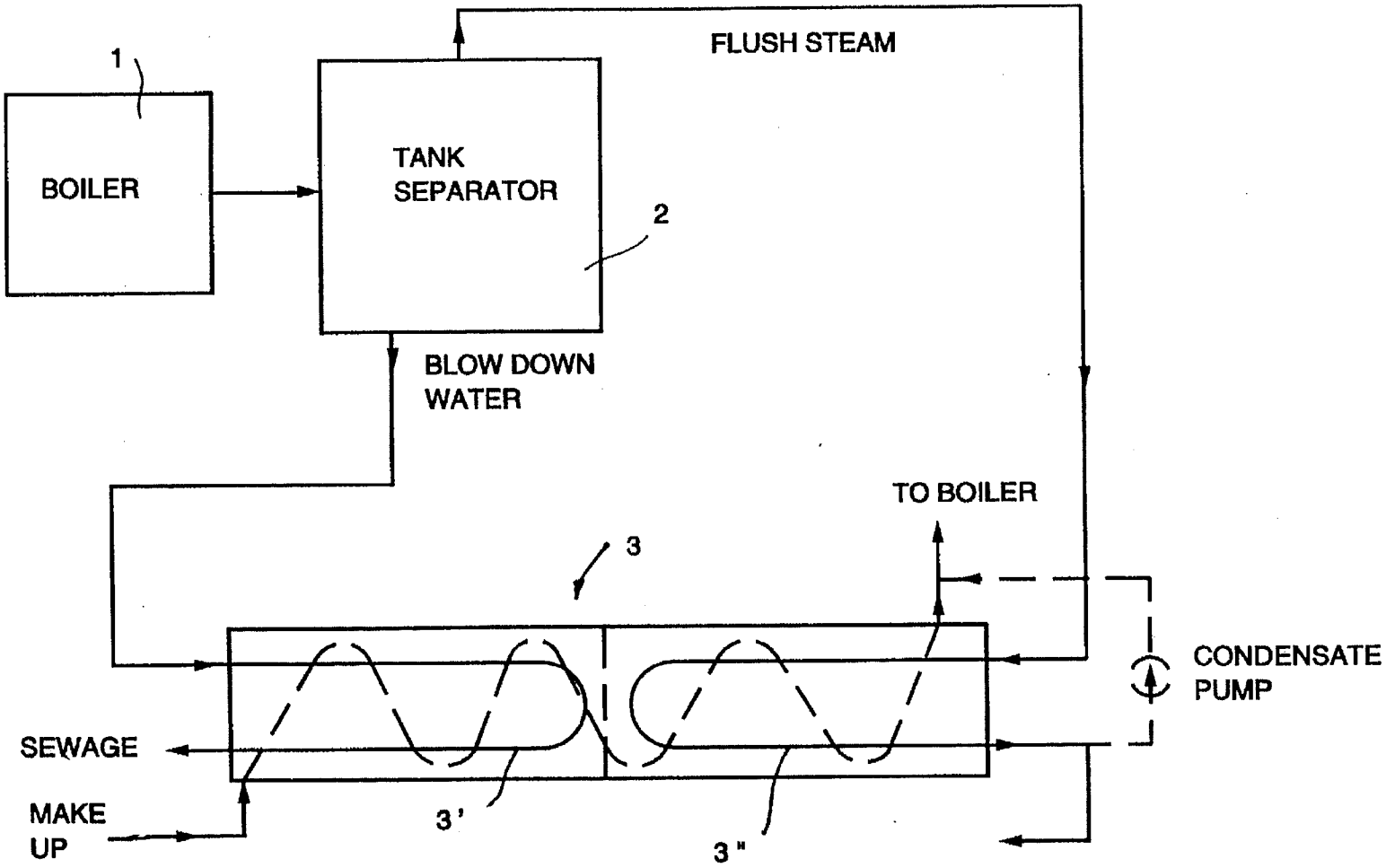
FIG. 1 of the drawings is a view schematically showing a heat recovery system for a boiler, and a boiler provided therewith.
Figure 2:
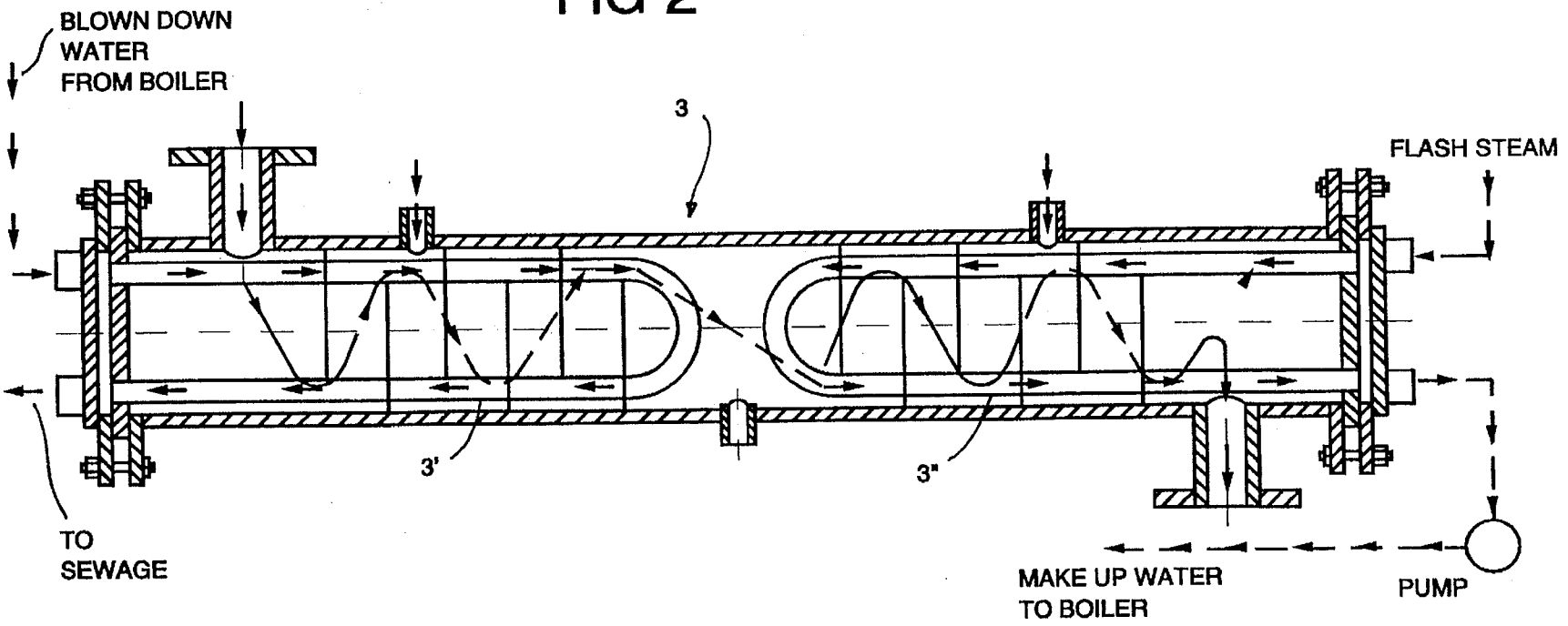
FIG. 2 is a view showing a heat exchanger for the inventive system.

A boiler with the recovery system is shown in the drawing. The boiler is identified as a whole with reference numeral 1. A tank separator 2 is connected with the boiler so that a liquid from the boiler is supplied to the tank separator. In the tank separator, as well known in the art, when the liquid supplied from the boiler is subdivided into a blow down water and a flush steam. The heat exchanger system is identified as a whole with reference numeral 3. The blow down water is supplied from the tank separator into the left part 3' of the heat exchanger and flows through the heat exchanger so as to be discharged at the end into a sewage. At the same time a make up water is supplied in the same left portion of the heat exchanger 3 so that when the hot blow down water, for example with temperature of 130° flows through the left portion of the heat exchanger, gives out heat through the walls of the corresponding conduits to the make up water flowing through the left portion of the heat exchanger which make up water was supplied for example with a temperature of 40°. Thus, the make up water can be heated for example to 60°.

In accordance with the present invention, the hot flush steam is supplied to the right portion 3" of the heat exchanger 3. As can be seen from the drawings, the make up water after being heated in the left part of the heat exchanger by the heat given out by the blow down water, is further supplied into the right portion of the heat exchanger and is further heated up by the heat given out by the flush steam which for example has a temperature of 230° . While the temperature of the blow down water in the left portion of the heat exchanger is reduced, the temperature of the flush steam in condensation remains the same. Thus, the make up water is heated further.

It is to be understood that the exchanger 3 can be formed as a single heat exchanger with two different portions or two separate heat exchangers connected with one another as shown in broken line in the center of the heat exchanger 3 in FIG. 1. As can be seen from the drawings, the condensate produced from the flush steam after passing through the right portion 3" of the heat exchanger 3 can be either discharged or supplied back by a condensate pump 4 back to a water line leading to the boiler or to another line in the inventive heat recovery system so as to further give out the heat contained in the condensate.

The system allows the use of heat of flush steam and condensate on any boiler with blow down system, even when there is no consumer for the low pressure steam, or the consumer is very far from the blow down system. In the inventive system the make up water is hereby heated successively by two heating media having an increasing temperature difference between the heating medium and the make up water, for example 60° difference between the blow down water and make up water in the section 3', and about 140°–150° between the flush steam and the make up water in the section 3".

Figure 3:
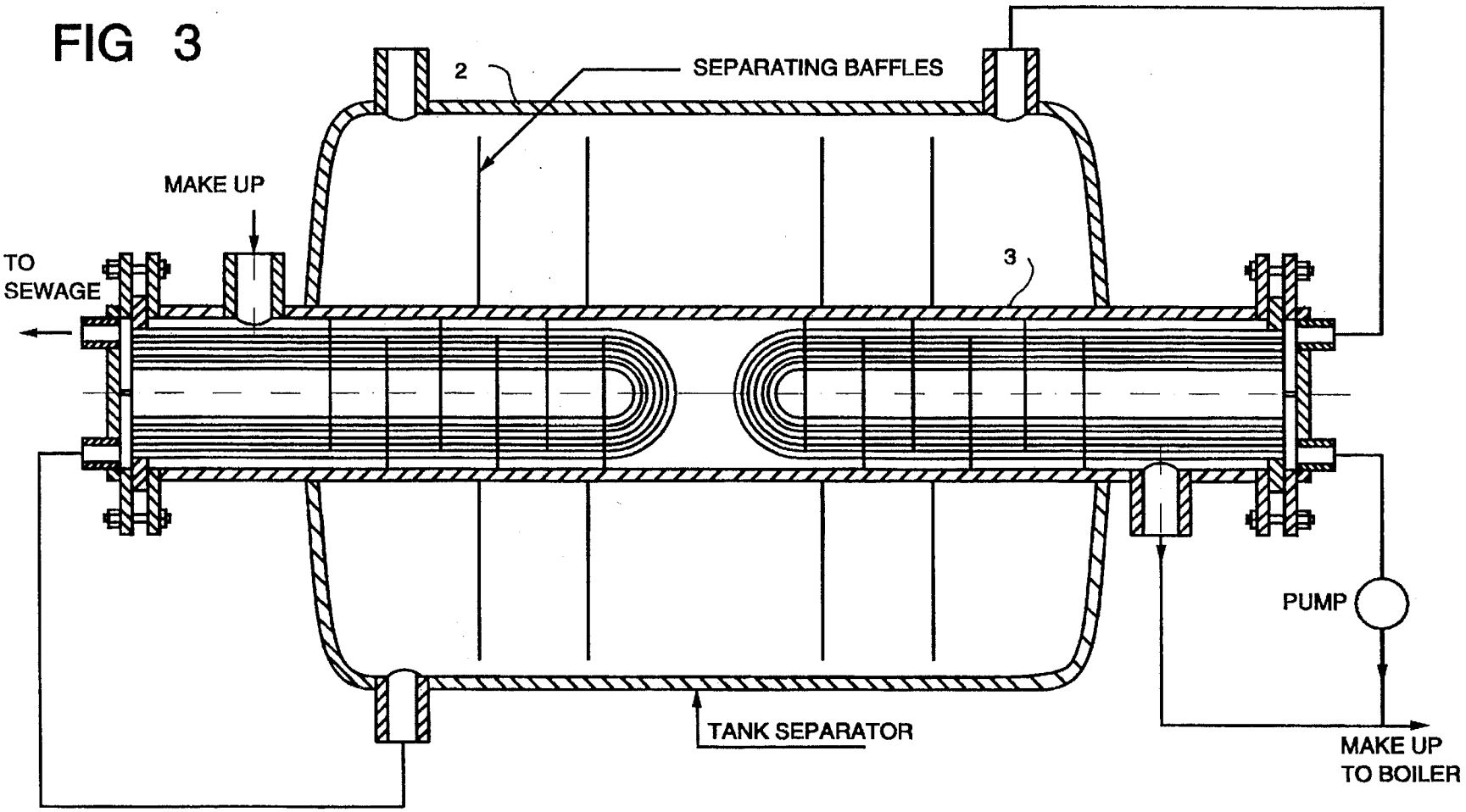
FIG. 3 shows a further modification of the heat recovery system in accordance with the present invention.

FIG. 3 shows a further modification of the inventive heat recovery system. The main difference of the construction shown in FIG. 3 is that the heat exchanger 3 is mounted in the tank separator 2. This simplifies the overall construction of the system.

It will be understood that each of the elements described above, or two or more together, may also find a useful application in other types of construction differing from the types described above.

While the invention has been illustrated and described as embodied in a heat recovery system for a boiler and a boiler provided with the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A heat recovery system for a boiler, comprising a tank separator connectable to a boiler and receiving a liquid from the boiler as well as separating the liquid into a blow down liquid and a flush vapor; a heat exchanger having an upstream portion and a downstream portion and receiving a make up water to be heated, said tank separator being connected with said upstream portion of said heat exchanger so as to apply hot blow down water into said upstream portion of said heat exchanger therefore to heat the make up water in said upstream portion of said heat exchanger by heat given out by the blow down water, said heat exchanger further having a downstream portion connected with said upstream portion so that the make up water heated by the heat given out by the blow down water further flows into the downstream portion of said heat exchanger, said tank separator being connected with said downstream portion of said heat exchanger so as to supply the flush steam into said downstream portion of said heat exchanger and further heat the make up water in said downstream portion of said heat exchanger by heat given out by the flush steam in said downstream portion of said heat exchanger.

2. A heat recovery system as defined in claim 1, wherein said heat exchanger is formed as a single unit including said upstream portion and said downstream portion.

3. A heat recovery system as defined in claim 1, wherein said upstream portion and said downstream portion of said heat exchanger are formed as separate heat exchanging elements which are successively connectable with one another.

4. A heat recovery system as defined in claim 1; and further comprising means for recirculating a condensate produced from the flush steam after heat is pressed through said downstream portion of said heat exchanger, back into the system.

5. A heat recovery system as defined in claim 4; and further comprising a line supplying the make up water after it leaves said downstream portion of said heat exchanger, to the boiler, said condensate pump recirculating the condensate into said line.

6. A heat recovery steam as defined in claim 1, wherein said heat exchanger is mounted in said tank separator.

7. A boiler with a heat recovery system, comprising a boiler; a tank separator connectable to said boiler and receiving a liquid from said boiler as well as separating the liquid into a blow down liquid and a flush vapor, a heat exchanger having an upstream portion and a downstream portion and receiving a make up water to be heated, said tank separator being connected with said upstream portion of said heat exchanger so as to apply hot blow down water into said upstream portion of said heat exchanger therefore to heat the make up water in said upstream portion of said heat exchanger by heat given out by the blow down water, said heat exchanger further having a downstream portion connected with said upstream portion so that the make up water heated by the heat given out by the blow down water further flows into the downstream portion of said heat exchanger, said tank separator being connected with said downstream portion of said heat exchanger so as to supply the flush steam into said downstream portion of said heat exchanger and further heat the make up water in said downstream portion of said heat exchanger by heat given out by the flush steam in said downstream portion of said heat exchanger.

* * * * *